US005201177A

United States Patent [19]

Kim

[11] Patent Number: 5,201,177

[45] Date of Patent: Apr. 13, 1993

[54] SYSTEM FOR AUTOMATICALLY CONTROLLING RELATIVE OPERATIONAL VELOCITY OF ACTUATORS OF CONSTRUCTION VEHICLES

[75] Inventor: Ju-kyung Kim, Masan, Rep. of Korea

[73] Assignee: Samsung Heavy Industries Co., Ltd., Rep. of Korea

[21] Appl. No.: 829,699

[22] Filed: Jan. 31, 1992

[30] Foreign Application Priority Data

Nov. 26, 1991 [KR] Rep. of Korea ..... 91-21329

[51] Int. Cl.[5] ..... F16D 31/02

[52] U.S. Cl. ..... 60/426; 60/459; 91/459; 91/513

[58] Field of Search ..... 60/421, 426, 427, 428, 60/429, 459; 91/513, 459

[56] References Cited

U.S. PATENT DOCUMENTS

| | | | |
|---|---|---|---|
| 4,625,622 | 12/1986 | Gunda et al. | 91/459 X |
| 4,745,744 | 5/1988 | Cherry et al. | 60/420 X |
| 4,768,339 | 9/1988 | Aoyagi et al. | 60/428 X |
| 4,844,685 | 7/1989 | Sagaser | 91/513 X |
| 4,856,278 | 8/1989 | Widmann et al. | 60/427 X |
| 4,881,450 | 11/1989 | Hirata et al. | 91/459 |
| 5,029,067 | 7/1991 | Nishida et al. | 60/421 X |

*Primary Examiner*—Edward K. Look

*Assistant Examiner*—Hoang Nguyen

*Attorney, Agent, or Firm*—Price, Heneveld, Cooper, DeWitt & Litton

[57] ABSTRACT

A system for automatically controlling the actuators of a construction vehicle. The system comprises electronic controller, an automatic selecting switch for selecting automatic control for actuators, as requested, control levers for being manipulated by an operator in order to instruct the controller of desired operations of the actuators, and positional sensors for sensing respective positions of the actuators and outputtng signals corresponding to the positions of the actuators to the controller. In the system, the actuators during performing repeated operations are such automatically controlled that they are controlled during a first operation by the operator's manipulations for the control levers, thereafter, during each sequential operation, they are automatically controlled by the controller on the basis of electric control currents having been automatically calculated by virtue of a displacement ratio between the actuators during a just previous operation. The system provides, therefore, advantage in that is provided with no relative operational velocity ratio setting device and causes the operator to omit a repeated setting by experience for the velocity ratio, thereby improving the operational effect of the excavator.

3 Claims, 4 Drawing Sheets

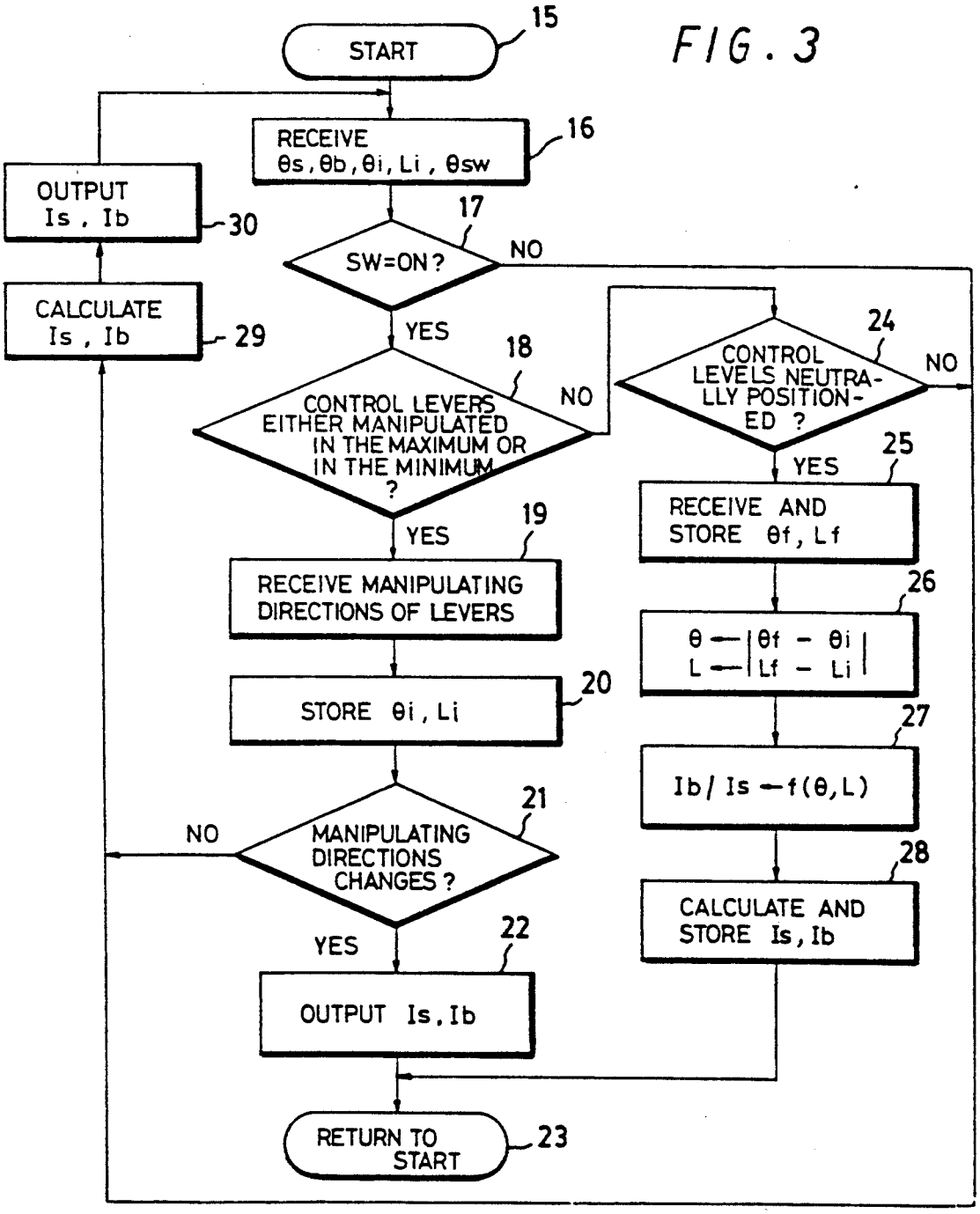
FIG. 3
START
15
RECEIVE θs, θb, θi, Li, θsw
16
SW=ON ?
17
NO
YES
CONTROL LEVERS EITHER MANIPULATED IN THE MAXIMUM OR IN THE MINIMUM ?
18
NO
YES
RECEIVE MANIPULATING DIRECTIONS OF LEVERS
19
STORE θi, Li
20
MANIPULATING DIRECTIONS CHANGES ?
21
NO
YES
OUTPUT Is, Ib
22
RETURN TO START
23
CONTROL LEVELS NEUTRALLY POSITIONED ?
24
NO
YES
RECEIVE AND STORE θf, Lf
25
θ ← |θf − θi|
L ← |Lf − Li|
26
Ib/Is ← f(θ, L)
27
CALCULATE AND STORE Is, Ib
28
OUTPUT Is, Ib
30
CALCULATE Is, Ib
29

SYSTEM FOR AUTOMATICALLY CONTROLLING RELATIVE OPERATIONAL VELOCITY OF ACTUATORS OF CONSTRUCTION VEHICLES

BACKGROUND OF THE INVENTION

1. Field of The Invention

The present invention relates to a system for automatically controlling operations of construction vehicles, and more particularly to an automatic system for controlling relative operational velocity of actuators of such construction vehicles which is capable of calculating, during a half cycle of an operation, relative operational velocity ratio between actuators on the basis of displacements of the actuators and calculating the electric control currents on the basis of the relative operational velocity ratio, then automatically controls, during the other half cycle of the operation, the flow rate of a hydraulic fluid outputted from main hydraulic pumps by using the electric control currents.

2. Description of The Invention

Conventionally, it is well known that hydraulic construction vehicles, such as an excavator, are useful industrial machines. The conventional construction vehicles are generally provided with a plurality of operational members which practically carry out desired operations, several actuators for actuating the operational members, a driving engine for supplying the driving power, hydraulic pumps for supplying compressed hydraulic fluid for the actuators upon receiving the driving power from the engine, proportional valves for controlling wobbling angles of wobble plates of the hydraulic pumps, directional control valves each adapted for controlling a flow rate and a flowing direction of the hydraulic fluid, a plurality of positional sensors for sensing displacements of the actuators, control levers/pedals being manipulated by the operator in order to instruct a desired operation, an electronic controller for controlling the operations of the actuators upon receiving manipulation signals from the control levers/pedals.

The actuators of the construction vehicles are controlled by virtue of operator's manipulation for the control levers/pedals so that the actuators efficiently actuates the operational members in order to carry out several operations such as an excavating operation, a surface finishing operation, a loading operation and the like.

During an operation of the construction vehicles, several actuators of the vehicles generally need to be operated by the operator at the same time. Here, each control lever is generally used for controlling two actuators. For example, in a loading operation by using an excavator, it is necessary that two of four actuators, that is, a swing motor and a boom cylinder or a bucket cylinder and a dipper stick cylinder are operated at the same time. In addition, each two actuators are simultaneously operated by means of a manipulation for a control lever. Thus, the operator has to manipulate two control levers at the same time by using both hands in order to operate the two actuators. In result, the known construction vehicles have disadvantage in that a manipulation for a control lever has to synchronize with other manipulation for another control lever so that the synchronizing manipulation for the control levers imposes a burden for the operator regardless of skill of the operator, thus causes the operational velocity of the construction vehicle to be slow, thereby resulting in deteriorating the operational effect of the construction vehicle.

In an effort for solving the above problem, there has been proposed construction vehicles which each is provided with an operational velocity setting device electrically connected to the controller in order to set a relative operational velocity ratio between two actuators and output an electric signal corresponding to the velocity ratio having been set by the setting device to the controller.

For example, The Japanese Patent Publication No. Sho. 63-93,936 discloses a representative example of the above-mentioned type of construction vehicle, that is, an excavator which is provided with a velocity setting device which automatically controls a relative operational velocity ratio between two actuators, as shown in FIG. 1.

FIG. 1 is a schematic view showing a relative connection between a hydraulic circuit and an electronic control circuit including a device for setting an operational velocity ratio between a swing motor and a boom cylinder of the excavator in accordance with the prior art.

As shown in the drawing, the excavator is provided with a driving engine 1 which is connected to a pair of hydraulic pumps, that is, first and second main pumps 2 and 3. The first main pump 2 is connected to a directional control valve 4 which is adapted for controlling flow rate and flowing direction of the hydraulic fluid for the swing motor 6, while the second main pump 3 is connected to a directional control valve 5 which is adapted for controlling flow rate and flowing direction of the hydraulic fluid for the boom cylinder 7. In addition, the directional control valves 4 and 5 each is electrically connected to an output port of an electronic controller 8. The input ports of the controller 8 is electrically connected to a boom cylinder control lever 9, a swing motor control lever 10, an automatic select switch 11 and an operational velocity setting device 12.

In operation, upon setting each desired operational velocity of the swing motor 6 and the boom cylinder 7 by using the operational velocity setting device 12 in order to predetermine a desired operational velocity ratio therebetween, the controller 8 controls the directional control valves 4 and 5 in order to cause the swing motor 6 and the boom cylinder 7 to be actuated at the operational velocity ratio set by the velocity setting device 12. Thus, if the operator simply manipulates the boom cylinder control lever 9 and the swing motor control lever 10 in the maximum, respectively, the controller 8 outputs control current signals to the directional control valves 4 and 5 in order to cause the swing motor 6 and the boom cylinder 7 to be automatically actuated at the operational velocity ratio. Accordingly in an operation, such as an excavating operation, the operator can so easily manipulate the control levers 9 and 10 for the actuators at the same time that he simply manipulates the control levers 9 and 10 in order to control the dipper stick cylinder and the bucket cylinder with disregarding the manipulation for the control levers 9 and 10 for controlling the swing motor 6 and the boom cylinder 7.

However, in the above excavator provided with the velocity setting device 12, the operator has to set by experience the operational velocity ratio between two actuators, thereby inducing a disadvantage in that the operator should be enough skilled to reliably set the operational velocity ratio between two actuators. Furthermore, the operator always sets new operational velocity ratio between two actuators when the operational condition changes, thereby inducing another disadvantage in that the operator is troubled with the repeated setting for the velocity ratio.

SUMMARY OF THE INVENTION

It is, therefore, an object of this invention to provide a system for controlling operational velocity of actuators of a construction vehicle in which the above-mentioned problems can be overcome, and which is capable of calculating relative operational velocity ratio between actuators on the basis of displacements of the actuators, then calculating electric control currents for controlling the actuators on the basis of the operational velocity ratio between the actuators and storing the electric control currents during a half cycle of an operation of the vehicle, then automatically controls during the other half cycle the flow rate and flowing direction of a hydraulic fluid of main hydraulic pumps by using the electric control currents having been calculated on the basis of the operational velocity ratio.

In one aspect, the above-mentioned object of this invention can be accomplished by providing an apparatus for automatically controlling actuators of a construction vehicle comprising: controlling means for automatically controlling operations of actuators of said vehicle; automatic selecting means for selecting automatic control for the actuators, as requested, and outputting a signal informing of a selecting state thereof to said controlling means; control lever means for being manipulated by an operator in order to instruct the controlling means of desired operations of the actuators; and sensing means for sensing respective positions of said actuators and outputting signals corresponding to the positions of the actuators to said controlling means, said sensing means each being disposed at each actuator, whereby during repeated operations which are performed by the vehicle, the actuators being such automatically controlled that they are controlled during a first operation by the operator's manipulation for the control lever means, thereafter, during each sequential operation, they are automatically controlled by the controlling means on the basis of electric control currents having been automatically calculated by virtue of an operational velocity ratio between the actuators during a just previous operation.

In another aspect, the above-mentioned object of this invention can be accomplished by providing a method for automatically controlling actuators of a construction vehicle by using the above apparatus, said method comprising the steps of: upon receiving signals from the automatic selecting means, the control lever means and the sensing means and determining whether the automatic selecting means has been turned on, determining whether the control lever means for the actuators has been either manipulated in the maximum or in the minimum; if the control lever means for the actuators has been either manipulated in the maximum or in the minimum, receiving manipulating direction of the control lever means and storing first present absolute positions of the actuators, said first positions having been received in the above step, then determining whether a present manipulating direction of the control lever means has changed into a direction opposite to a just previously manipulating direction thereof; if the present manipulating direction of the control lever means has been equal to the just previously manipulating direction thereof, calculating electric control currents for controlling the actuators in accordance with the operator's manipulation for the control lever means, then outputting said electric control currents to directional control valves of the actuators; if the control lever means for the actuators has been manipulated neither in the maximum nor in the minimum, determining whether the control lever means for the actuators has been positioned at a neutral position; if the control lever means for the actuators has been positioned at the neutral position, receiving second present absolute positions of the actuators from the sensing means and storing the second present absolute positions therein, calculating respective absolute positional values of the actuators by subtracting the first absolute positions of the actuators from the second absolute positions thereof, calculating a relative operational velocity ratio between the actuators on the basis of the absolute positional values, then calculating electric control currents for controlling the actuators on the basis of the operational velocity ratio between the actuators and storing the electric control currents; and if it is determined that the control lever means has changed into the direction opposite to the just previously manipulating direction thereof, outputting the electric control currents having been calculated on the basis of the operational velocity ratio in the above step to the directional control valves of the actuators.

BRIEF DESCRIPTION OF THE DRAWINGS

The above and other objects, features and other advantages of the present invention will be more clearly understood from the following detailed description taken in conjunction with the accompanying drawings, in which:

FIG. 3 is a flowchart showing a process for controlling relative operational velocity between the swing motor and the boom cylinder of the excavator performed by the apparatus of FIG. 2;

DETAILED DESCRIPTION OF THE PREFERRED EMBODIMENTS

In the following description, the present invention will be described in conjunction with an excavator which is a representative example of construction vehicles. However, the following description for the excavator is only for illustrative purpose, thus those skilled in the art will appreciate that this invention can be applied to construction vehicles regardless of the kinds thereof.

Figure 1:
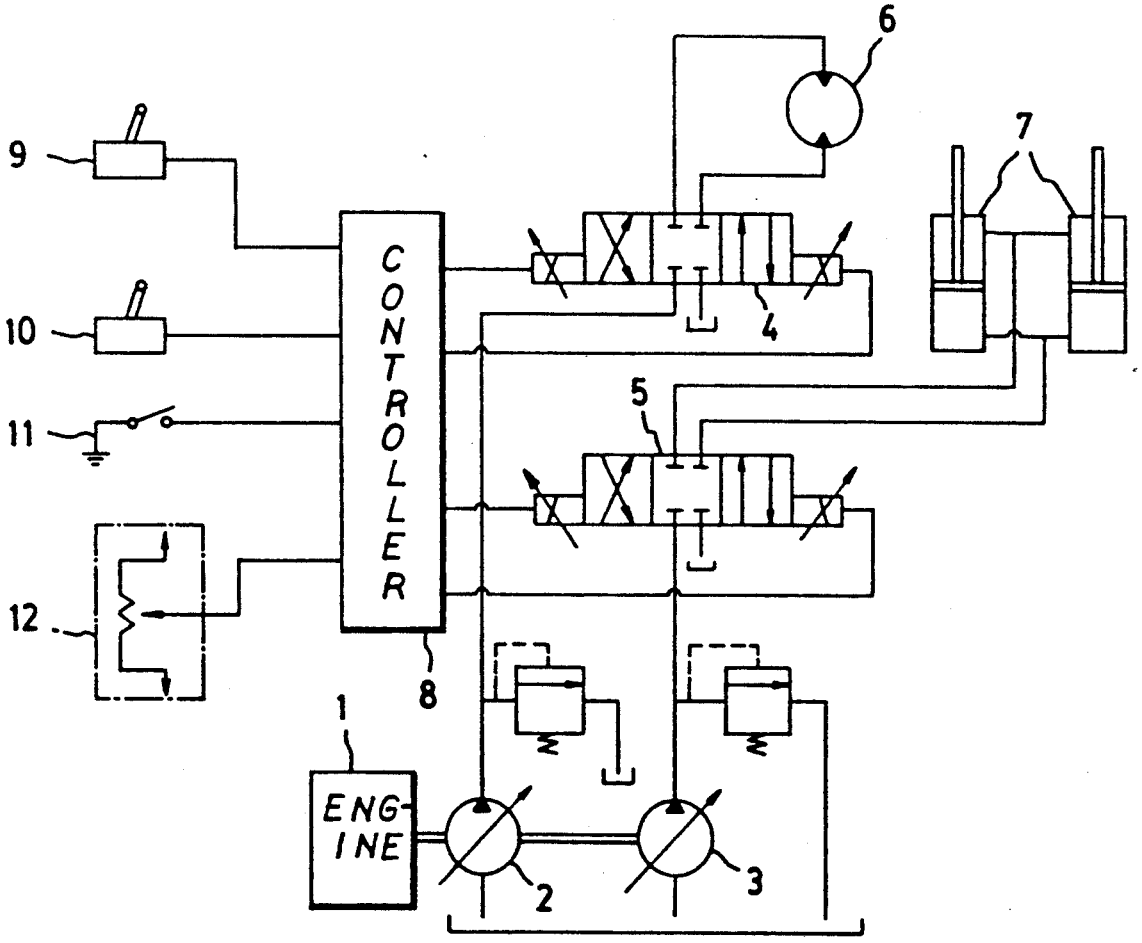
FIG. 1 PRIOR ART
FIG. 1 is a schematic view showing a relative connection between a hydraulic circuit and electronic control circuit including a device for setting an operational velocity ratio between a swing motor and a boom cylinder of an excavator in accordance with the prior art.
Figure 2:
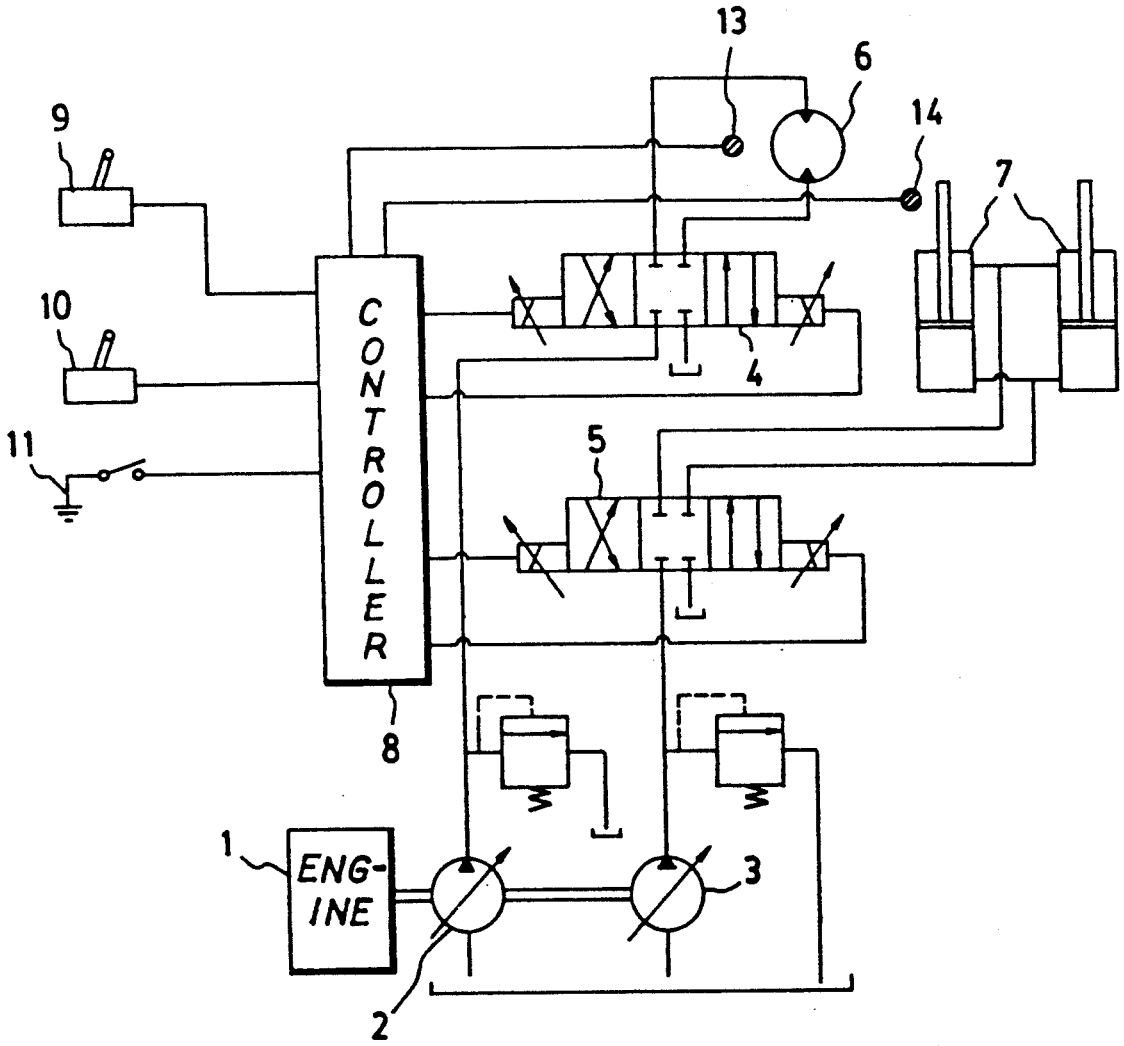
FIG. 2 is a view corresponding to FIG. 1, but showing an apparatus for controlling operational velocity of actuators of an excavator according to the present invention.

Referring to FIG. 2 which is a schematic view showing a relative connection between a hydraulic circuit and an electronic control circuit including an apparatus for controlling operational velocity of between a boom cylinder and a swing motor of an excavator in accordance with this invention. The excavator is provided with a driving engine 1 which is connected to a pair of hydraulic pumps, that is, first and second main pumps 2 and 3. The first main pump 2 is connected to a directional control valve 4 which is adapted for controlling a flow rate and a flowing direction of a hydraulic fluid for the swing motor 6, while the second main pump 3 is connected to a directional control valve 5 which is adapted for controlling a flow rate and a flowing direction of the hydraulic fluid for the boom cylinder 7.

In addition, the directional control valves 4 and 5 each is electrically connected to an output port of an electronic controller 8, said controller 8 comprising, for example, a conventional microcomputer. The input ports of controller 8 are electrically connected to a boom cylinder control lever 9, a swing motor control lever 10 and an automatic select switch 11.

On the other hand, there are provided, in the apparatus for controlling operational velocity of between a boom cylinder and a swing motor, a pair of positional sensors 13 and 14 which are disposed at the swing motor 6 and the boom cylinder 7, respectively. The sensors 13 and 14 are electrically connected to the input ports of controller 8 and adapted for sensing operational positions of the swing motor 6 and the boom cylinder 7, then outputting electric signals corresponding to the operational positions, respectively, to the controller 8 in order to allow the controller 8 to calculate respective displacements of the swing motor 6 and the boom cylinder 7 resulting from being actuated in accordance with operator's manipulations for the control levers 9 and 10. In the apparatus for controlling operational velocity of between the boom cylinder 7 and the swing motor 6 of the excavator of FIG. 2, there is provided no operational velocity setting device 12 which was provided with an excavator according to the prior art.

The process for automatically controlling the relative operational velocity between the swing motor 6 and the boom cylinder 7 by means of the apparatus for controlling operational velocity of between the boom cylinder 7 and the swing motor 6 of the excavator of FIG. 2 will be described in detail in conjunction with a flowchart of FIG. 3, as follows.

As described in the flowchart, the controller 8 first performs a step 16 wherein it receives several electric signals, that is, electric signals corresponding to operator's manipulations $\theta s$ and $\theta b$ for the control levers 9 and 10 and outputted from the control levers 9 and 10, respectively, signals corresponding to present positions $\theta i$ and Li of the actuators 6 and 7 and outputted from the positional sensors 13 and 14, and a signal informing of the selecting state $\theta sw$ of the automatic select switch 11. Thereafter, at an inquiry step 17 it is determined, on the basis of the signal from the select switch 11, whether the select switch 11 has been turned on.

If the select switch 11 has been turned on, it is considered that the swing motor 6 and the boom cylinder 7 of the excavator are automatically controlled by means of the relative operational velocity control apparatus of this invention. Thus, the controller 8 performs a next inquiry step 18 wherein it is determined whether the control levers 9 and 10 are either manipulated in the maximum or in the minimum, respectively. At this time, the manipulations in the maximum for the control levers 9 and 10 can be accomplished by such manipulation for the control levers 9 and 10 that the boom control lever 9 is manipulated in order to reach the maximum booming up position, and the swing motor control lever 10 is manipulated in order to reach the maximum rightward swinging position. On the contrary, the manipulations in the minimum for the control levers 9 and 10 can be accomplished by such manipulation the control levers 9 and 10 that the boom control lever 9 is manipulated in order to reach the maximum booming down position and the swing motor control lever 10 is manipulated in order to reach the maximum leftward swinging position.

On the contrary, at the step 17 it has been determined that the select switch 11 was turned off, it is considered that the swing motor 6 and the boom cylinder 7 of the excavator are manually controlled by the operator without using the relative operational velocity control system of this invention. Thus, the controller 8 performs a step 29 in order to calculate electric control currents Is' and Ib' for controlling the directional control valves 4 and 5 in accordance with the operator's manipulations $\theta s$ and $\theta b$ for the control levers 9 and 10. Then, at a step 30 the controller 8 outputs electric control signals of Is' and Ib' to the directional control valves 4 and 5. Thereafter, the process returns to the start step.

On the other hand, if it is determined, at the step 18, that the control levers 9 and 10 have been either manipulated in the maximum or in the minimum, the controller 8 performs a step 19 wherein manipulating directions of the control levers 9 and 10 are received by the controller 8. The controller 8 then receives at a step 20 the absolute positional value $\theta i$ of the swing motor 6 and the positional value Li of the boom cylinder 7 at that time, then stores the absolute positional values $\theta i$ and Li in a RAM (not shown) thereof, said values $\theta i$ and Li having been applied from the positional sensors 13 and 14 to the controller 8. The controller 8 then determines at an inquiry step 21 whether the present manipulating directions of the control levers 9 and 10 change into directions opposite to the previously manipulating directions of the control levers 9 and 10.

If the present manipulating directions of the control levers 9 and 10 are equal to the previously manipulating directions, it is considered that the excavator is continuously performing a moving operation after accomplishing an excavating operation, said moving operation being carried out in order to move the excavator from the excavating position to the loading position. Thus, the controller 8 performs the steps 29 and 30 in order to control the actuators 6 and 7 in accordance with the operator's manipulations $\theta s$ and $\theta b$ for the control levers 9 and 10.

However, if it is determined that the present manipulating directions of the control levers 9 and 10 change into directions opposite to the previously manipulating directions, it is considered that the excavator is performing a returning operation in order to reach the position for performing a new excavating operation after accomplishing the previous loading operation. Thus, the controller 8 performs a next step 22 wherein it outputs electric control signals of electric control currents Is and Ib to the directional control valves 4 and 5. The process for calculating the electric control currents Is and Ib will be again described in detail.

Upon accomplishing the control for the actuators 6 and 7 by means of the electric control currents Is' and Ib' for controlling the directional control valves 4 and 5 in accordance with the operator's manipulations θs and θb, the controller 8 again performs the steps 16 to 18. At this time, the excavator is performing the loading operation by using the dipper stick cylinder and the bucket cylinder so that the control levers 9 and 10 for the swing motor 6 and the boom cylinder 10 are positioned at neutral positions thereof. Hence, at the step 18 it is determined that the control levers 9 and 10 are manipulated neither in the maximum nor in the minimum. Thus, the controller 8 performs a step 24 wherein it is determined whether the control levers 9 and 10 are positioned at neutral positions thereof. At the step 24, if it is determined that the control levers 9 and 10 are not positioned at the neutral positions, the controller 8 performs the above-mentioned steps 29 and 30. However, if the control levers 9 and 10 are positioned at the neutral positions, the controller 8 performs next steps 25 to 28. At the step 25, the controller 8 receives an absolute positional value θf of the swing motor 6 and a positional value Lf of the boom cylinder 7 at that time.

Figure 4:
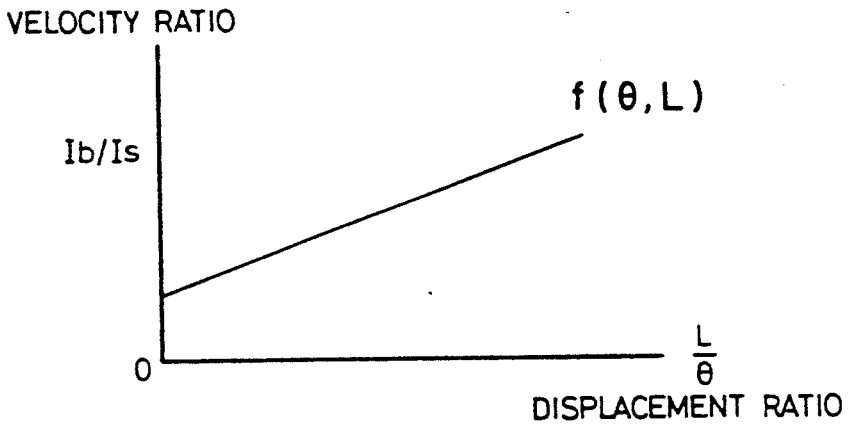
FIG. 4 is a graph showing the characteristic curve of an operational velocity ratio Ib/Is between the boom cylinder and the swing motor on the basis of a ratio $L/\theta$ between absolute displacement values of the boom cylinder and the swing motor in accordance with this invention.

Thereafter, at the step 26 the controller 8 calculates respective absolute values θ and L, that is, the displacements, of the swing motor 6 and the boom cylinder 7 by subtracting the absolute positional values θi and Li, having been stored in the RAM of the controller 8 at the step 20, from the absolute positional values θf and Lf having been received at the step 25, respectively. Thereafter, at the step 27 the controller 8 calculates a relative operational velocity ratio Ib/Is between the boom cylinder 7 and the swing motor 6 on the basis of the respective absolute values θ and L, having been calculated at the step 26. At this time, the controller 8 calculates the relative operational velocity ratio, that is, the ratio Ib/Is between the electric control current Ib for controlling the boom cylinder 7 and the electric control current Is for controlling the swing motor 6, on the basis of a characteristic graph, for example, a graph of FIG. 4 which is a graph showing the characteristic curve of an operational velocity ratio Ib/Is between the boom cylinder and the swing motor on the basis of a ratio L/θ between absolute displacement values of the boom cylinder and the swing motor in accordance with this invention.

Figure 5:
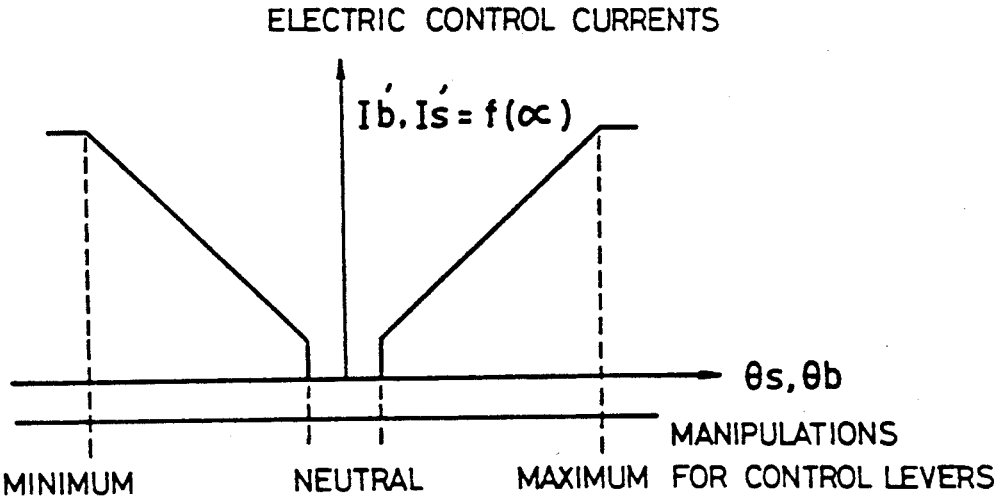
FIG. 5 is a graph showing the characteristic curves of the electric control currents Ib' and Is' for the boom cylinder and the swing motor on the basis of manipulations for the boom cylinder control lever and the swinging motor control lever in accordance with this invention.

The controller 8 then calculates at the step 28 the electric control currents Is and Ib on the basis of the relative operational velocity ratio Ib/Is between the boom cylinder 7 and the swing motor 6, then stores the electric control currents Is and Ib in the RAM thereof. In this calculation, relatively higher one of the currents Ib and Is can be obtained according to a graph of FIG. 5 which shows the graph showing the characteristic curves of the electric control currents Ib' and Is' for the boom cylinder 7 and the swing motor 6 on the basis of manipulations θb and θs for the boom cylinder and swinging motor control levers 9 and 10 in accordance with this invention, while the relatively lower other of the currents Ib and Is can be obtained from the relative operational velocity ratio Ib/Is. In result, the controller 8 accomplishes the control actuators of the excavator for the loading operation.

Thereafter, the excavator has to perform another excavating operation, thus has to perform a returning operation for returning from the loading position to the excavating position. Thus, the operator manipulates the control levers 9 and 10 in opposite directions to those of the just previous moving operation. In result, the controller 8 performs another process which starts from the step 28.

Upon storing the electric control currents Is and Ib therein, the controller 8 performs the steps 16 and 17. At the step 17, if it is determined that the select switch 11 has been turned on, it is considered that the swing motor 6 and the boom cylinder 7 of the excavator are automatically controlled by means of the relative operational velocity control apparatus. Thus, the controller 8 sequentially performs the steps 18 to 21. At this time, the control levers 9 and 10 have been manipulated in the opposite directions as described above. Thus, at the step 21 the controller 8 determines that the manipulating directions for the control levers 9 and 10 change into the directions opposite to the previous manipulations for carrying out the previous moving operation. Hence, the controller 8 performs a step 22 wherein the electric control currents Is and Ib are outputted from the controller 8 to the directional control valves 4 and 5 in order to automatically control the actuators 6 and 7.

Therefore, the excavator accomplishes the returning operation for returning to the excavating position for carrying out the another excavating operation.

Thereafter, in the excavating operation of the excavator by using the dipper stick cylinder and the bucket cylinder, the control levers 9 and 10 for the swing motor 6 and the boom cylinder 7 are positioned at the neutral positions thereof. At this time, the controller 8 performs another process which starts from the step 16. Thus, at the step 17 the controller 8 determines that the control levers 9 and 10 are manipulated neither in the maximum nor in the minimum so that the controller 8 performs the steps 24 to 28, thereby determining another electric control currents Ib and Is through the same process as described above.

In addition, upon accomplishing the excavating operation, the excavator has to be operated in order to move to the loading position so that the operator manipulates the control levers 9 and 10 in the directions opposite to the previous manipulations, that is, the manipulations in the just previous returning operation. In result, the controller 8 performs another process which starts from the step 28.

Upon storing the electric control currents Is and Ib therein, the controller 8 performs the steps 16 and 17. Thus, the controller 8 sequentially performs the steps 18 to 21. At this time, the control levers 9 and 10 have been manipulated in the opposite directions, as described above. Thus, at the step 21 the controller 8 determines that the manipulating directions for the control levers 9 and 10 change into the directions opposite to the previous manipulations. Hence, the controller 8 performs the step 22 wherein electric control currents Is and Ib are outputted from the controller 8 to the directional control valves 4 and 5 in order to automatically control the actuators 6 and 7, thereby causing the excavator to move to the loading position.

In brief, the system for automatically controlling the relative operational velocity between the actuators of the excavator according to this invention controls the actuators, for example, a swing motor and a boom cylinder of the excavator in an excavating and loading operation, to be actuated by the operator's manipulations for the control levers during the first moving operation for moving from the excavating position to the loading position. During the loading operation after accomplishing the moving operation, the system calculates, under the condition that the control levers for the swing motor and the boom cylinder are positioned at the neutral positions, a relative operational velocity ratio between the swing motor and the boom cylinder by using the positional displacements of the actuators, then calculates, on the basis of the relative operational velocity ratio, the electric control currents Is and Ib for controlling the swing motor and the boom cylinder, thereafter stores the electric control currents Is and Ib.

Thereafter, during a returning operation of the excavator for returning from the loading position to the excavating position, the system controls the swing motor and the boom cylinder by using the electric control currents Is and Ib having been stored therein during the just previous loading operation. During the excavating operation of the excavator after accomplishing the returning operation, the system calculates, under the condition that the control levers are positioned at the neutral positions, a new relative operational velocity ratio between the swing motor and the boom cylinder by using positional displacements of the swing motor and the boom cylinder, then calculates, on the basis of the new relative operational velocity ratio, the electric control currents Is and Ib for controlling the swing motor and the boom cylinder, thereafter stores the electric control currents Is and Ib.

Sequentially, during a new moving operation of the excavator for moving from the excavating position to the loading position, the system controls the swing motor and the boom cylinder by using the electric control currents Is and Ib having been stored therein during the previous excavating operation. Thereafter, during the loading operation after accomplishing the moving operation, the system calculates new electric control currents Is and Ib in the same manner as described in the above description for the first loading operation.

Thereafter, during the sequential excavating and loading operations and the moving and returning operations of the excavator, the system of this invention automatically calculates new electric control currents Is and Ib in the same manner as described in the above description, and controls the actuators by using the electric control currents Is and Ib.

Thus, the actuators are such automatically controlled that they are controlled, during the first moving operation for moving from the excavating position to the loading position, by the operator's manipulations, thereafter, during the sequential returning and moving operation, the actuators are automatically controlled by using respective electric control currents Is and Ib newly calculated during the just previous operation.

As described above, the present invention provides a system for automatically controlling the actuators of a construction vehicle in which the actuators are such automatically controlled that they are controlled, during the first loading operation, by the operator's manipulations, thereafter, during the sequential loading and excavating operation, the actuators are automatically controlled by using respective electric control currents newly calculated during the previous operation. Thus, the system of this invention provides an advantage in that a relative operational velocity ratio does not need to be set by the operator but automatically set so that the excavator is provided with no relative operational velocity ratio setting device and the operator is able to omit a repeated setting by experience for the velocity ratio, which may cause the operator to be trouble, thereby improving the operational effect of the excavator.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. An apparatus for automatically controlling actuators of a construction vehicle having a swing part and a travel part, comprising a swing motor, a boom and a boom cylinder; first and second main hydraulic pumps for delivering pressurized fluid for driving the actuators including said swing motor for turning, using the pressurized fluid of said first main hydraulic pump, said swing part with respect to said travel part of the construction vehicle, and said boom cylinder for driving, using the pressurized fluid of said second main hydraulic pump, said boom of the construction vehicle; a pair of directional control valves for controlling flow direction and quantity of the pressurized fluid which is to be distributed to said swing motor and said boom cylinder; control levers for outputting signals corresponding to manipulation values; and an automatic select switch for outputting a signal informing of a selected state, said apparatus further comprising:

a controller;

a boom displacement sensor for sensing positional displacement of said boom cylinder and outputting to said controller a signal corresponding to the sensed positional displacement of said boom cylinder; and a swing displacement sensor for sensing the rotating angle of said swing motor and outputting a signal corresponding to the sensed rotating angle of said swing motor to said controller, said controller including means for controlling said swing motor and said boom cylinder in such a manner that it first controls said swing motor and said boom cylinder by the signals corresponding to the manipulation values of said control levers, and thereafter, automatically controls, in each sequential operation, said swing motor and said boom cylinder using electric control currents based on an operational velocity ratio of said boom cylinder to said swing motor determined by the signals outputted from said sensors in a just previous operation.

2. The apparatus of claim 1 wherein said means for controlling said swing motor and said boom cylinder having capability of controlling said boom cylinder and said swing motor in a next operation in accordance with the optimum operational velocity ratio thereof.

3. A method for automatically controlling actuators of a construction vehicle having control levers, an automatic select switch, a swing motor, a boom cylinder, a boom, displacement sensors, and directional control valves to said swing motor and boom cylinder, comprising the steps of:

receiving signals respectively corresponding to manipulation values of said control levers, a selected state of said automatic select switch and displacement values of said swing motor and said boom cylinder, each sensed by one of said displacement sensors, determining whether said automatic select switch has been turned on, then determining whether said control levers have been either manipulated at the maximum or at the minimum;

if it is determined that said automatic select switch has been turned on and said control levers have been manipulated either at the maximum or at the minimum, producing signals corresponding to manipulating directions of said control levers and storing first present absolute positions of said boom cylinder and said swing motor, said first positions having been received in the above step, then determining whether present manipulating directions of said control levers have changed into directions opposite to manipulating directions of the just previous operation;

if the present manipulating directions of the control levers have been equal to the manipulating directions of the previous operation, producing electric control currents for controlling the boom cylinder and the swing motor in accordance with the manipulation values of the control levers, then outputting said electric control currents to directional control valves for controlling flow direction and quantity of the pressurized fluid which is to be distributed to said swing motor and said boom cylinder;

determining, if the control levers have been manipulated neither at the maximum nor at the minimum, whether said control levers have been positioned at neutral positions, respectively;

receiving, if the control levers have been positioned at the neutral positions, respectively, second present absolute positions of said boom cylinder and said swing motor from the displacement sensors and storing the second present absolute positions, calculating respective absolute positional values of said boom cylinder and said swing motor by subtracting said first absolute positions from said second absolute positions, calculating a relative operational velocity ratio of the boom cylinder to the swing motor on the basis of the absolute positional values, then calculating electric control currents for controlling the boom cylinder and the swing motor on the basis of said operational velocity ratio of the actuators and storing the electric control currents;

outputting, if it is determined that the control levers have changed into the directions opposite to manipulating directions of a previous operation, the electric control currents having been calculated on the basis of the operational velocity ratio calculated in the above step to said directional control valves of the actuators, then returning to the first step; and calculating, if the automatic select switch has been turned off or the control levers have not been positioned at the neutral positions, electric control currents for controlling the boom cylinder and the swing motor in accordance with the manipulation values of the control levers, then outputting said electric control currents to said directional control valves.

* * * * *